US006068253A

United States Patent [19]

Mueller et al.

[11] Patent Number: 6,068,253

[45] Date of Patent: May 30, 2000

[54] ADJUSTABLE SHEET SEPARATING DEVICE

[75] Inventors: Henry J. Mueller; Eliot S. Smithe, both of Duncansville, Pa.

[73] Assignee: F.L. Smithe Machine Company, Inc., Duncansville, Pa.

[21] Appl. No.: 09/050,631

[22] Filed: Mar. 30, 1998

[51] Int. Cl.[7] ..... B65H 3/12; B65H 1/22; B65H 5/02

[52] U.S. Cl. ..... 271/94; 271/96; 271/151; 271/276

[58] Field of Search ..... 271/30.1, 940, 271/96 C, 104, 105, 151 C, 276 C

[56] References Cited

U.S. PATENT DOCUMENTS

| | | | |
|---|---|---|---|
| 1,045,551 | 11/1912 | Hollings . | |
| 2,406,765 | 9/1946 | Harrold | 271/28 |
| 3,153,533 | 10/1964 | Novick | 271/2 |
| 3,379,432 | 4/1968 | Rüth | 271/2 |
| 4,345,752 | 8/1982 | Nakamura et al. | 271/12 |
| 4,740,813 | 4/1988 | Roy | 355/3 X |
| 5,241,907 | 9/1993 | Dorsam et al. | 101/409 X |
| 5,291,260 | 3/1994 | Johnson et al. | 355/312 X |
| 5,480,238 | 1/1996 | Haupenthal et al. | 271/276 |
| 5,803,445 | 9/1998 | Eberle | 271/3.11 X |
| 5,938,193 | 8/1999 | Bluemle et al. | 271/243 X |

FOREIGN PATENT DOCUMENTS

| | | | |
|---|---|---|---|
| 1222019 | 6/1960 | France . | |
| 284111 | 10/1913 | Germany . | |
| 407366 | 12/1924 | Germany . | |
| 56-61243 | 5/1981 | Japan | B56H 3/10 |

*Primary Examiner*—William E. Terrell
*Assistant Examiner*—Kenneth Bower
*Attorney, Agent, or Firm*—Price & Adams

[57] ABSTRACT

A leading edge of a leading blank in a series of overlapping envelope blanks is fed at a preselected speed into contact with a rotatably mounted backing roller. The backing roller is mounted in a frame and is selectively adjustable between a first position and a second position. A rotatably mounted segment roller is positioned opposite the backing roller. A pull-out segment is a secured to a radial portion of the backing roller. A plurality of longitudinal slots are provided in the surface of the pull-out segment and are selectively connected to a source of negative pressure. The segment roller is driven at a preselected speed greater than the speed of the series of overlapping blank. In a first mode of operation, the backing roller is adjusted to a first position in the frame so that upon rotation, the pull-out segment frictionally engages the leading edge of the leading blank, separating it from the series of overlapping blanks. In a second mode of operation the backing roller is adjusted to a second position so that the pull-out segment is removed from frictional engagement with the leading edge of the leading blank. Negative pressure is exerted through the longitudinal slots. Upon rotation of the segment roller, the negative pressure secures the leading edge of the leading blank to the pull-out segment separating the leading blank from the series of overlapping blanks.

20 Claims, 2 Drawing Sheets

ADJUSTABLE SHEET SEPARATING DEVICE

BACKGROUND OF THE INVENTION

1. Field of the Invention

This invention relates to method and apparatus for conveying individual blanks of sheet material and, more particularly, to method and apparatus for engaging the leading blank in a group of overlapping blanks and separating the leading blank from the group of overlapping blanks.

2. Description of the Prior Art

It is conventional practice in many sheet feeding operations to advance sheets of material in overlapping relation along various stations of a processing machine such as a drying station in an envelope making machine. At some point, it is often desired to remove the sheets from overlapping or shingled relation into spaced tandem relation thereby enabling subsequent operations to be performed on individual sheets.

To separate a first sheet from a group of overlapping sheets, a pull-out segment roller is conventionally utilized to frictionally engage the leading edge of the first sheet and accelerate it out of overlapping relation with the remaining sheets. Several examples of conventional friction separation mechanisms are illustrated in U.S. Pat. Nos. 1,153,533 and 3,379,432.

U.S. Pat. No. 1,153,533 discloses apparatus for aligning envelope blanks. A series of overlapping blanks are positioned at the entry portion of the machine. The bottom edge of the first blank partially rests on a backing roller. A rotating segment roller is positioned in parallel relation to the backing roller and a pull-out segment is rigidly mounted on the segment roller. The segment roller is positioned so that as it rotates the outer surface of the pull-out segment frictionally engages the leading edge of the first blank resting on the backing roller. The rotating pull-out segment grips the leading edge of the first blank and removes it from overlapping relation with the remaining blanks.

In U.S. Pat. No. 3,379,432, a group of overlapping envelope blanks are positioned before a rotary aligner mechanism. Prior to alignment, the blanks are separated from overlapping arrangement by a pull-out segment device similar to that disclosed in U.S. Pat. No. 3,153,533. A cylinder having a withdrawing roller segment frictionally engages the leading edge of the topmost blank in the group. The action of the withdrawing roller segment against its associated counter-roller grips the topmost blank and removes it from overlapping relation.

The frictional separation of blanks by a pull-out segment, though well known and used, is not without its drawbacks. It has been found that depending upon the weight and style of paper to be fed, frictional separation can cause marks to appear on the blank. The marks are often visible in the finished product and detract from its overall quality. To counteract the formation of marks, it is well known to utilize vacuum cylinders to separate overlapping blanks. Several examples of conventional vacuum style separators are illustrated in U.S. Pat. Nos. 1,045,551, 2,406,765, and 4,345,752; Japanese Patent No. 56-61243; and Xerox Disclosure Journal Vol. 9, No. 6, November 1984.

In U.S. Pat. No. 1,045,551, a segmented rotating vacuum separator cylinder is used to separate the topmost sheet from a stack. A series of ports receiving negative pressure are located on the outer surface of the vacuum separator cylinder and at a point in the cylinder's rotation, the ports are positioned in close relation to the topmost sheet in the stack. The negative pressure at the ports causes the topmost sheet (and possibly several adjacent sheets) to adhere to the surface of the vacuum separator cylinder. The rotation of the cylinder lifts the sheet(s) away from the stack and on to subsequent operations.

Means is also provided to prevent the separation of more than one sheet at a time. As the sheet(s) are rotated on the surface of the vacuum separator cylinder, an adjacent frictionally coated cylinder rotates into close parallel relation to the sheets. The frictional surface of the adjacent cylinder lightly grazes the separated sheets and causes all but the first sheet to release from the vacuum separator cylinder and return to the stack, thereby preventing more than one sheet to be separated from the stack simultaneously.

U.S. Pat. No. 2,406,765 also discloses a vacuum separator mechanism in which the topmost sheet in a stack is positioned for removal from the stack by a rotating cylinder having a vacuum port on its outer surface. As the cylinder rotates, the vacuum port becomes positioned adjacent the upper surface of the topmost sheet. A blast of air lifts the topmost sheet and causes the sheet to adhere to the vacuum port in the rotating cylinder. Subsequent blasts of air cause the remaining length of the topmost sheet to be separated from the stack. Movement of the vacuum cylinder forces the topmost sheet to enter a set of feed rollers which advance the topmost sheet to subsequent stations in the machine away from the stack.

U.S. Pat. No. 4,345,752 and Japanese Patent No. 56-61243 disclose a device for separating the topmost blank from a stack of blanks. A cylinder having a plurality of vacuum ports in its outer surface is rotated very close to the upper surface of the topmost blank where its rotation is momentarily halted. Vacuum pressure exerted through the ports lifts the topmost blank into engagement with the vacuum cylinder and the further rotation of the cylinder removes the sheet to subsequent operations. Additional vacuum ports adjacent to the stack engage the blanks immediately below the topmost sheet to prevent these blanks from becoming separated along with the topmost blank.

Xerox Disclosure Journal Vol. 9, No. 6 dated November 1984 discloses a device for removing and placing labels in a labeling machine. A plurality of vacuum pads are spaced apart on a cylinder. As the cylinder rotates, each pad engages a label to its surface by vacuum pressure. Subsequent rotation of the cylinder puts the pad in a position adjacent the surface of a document. The vacuum pressure is removed and the label is affixed to the document at that location.

When separating blanks from a moving overlapped group, the speed of the first blank must be substantially increased from the remainder of the group to facilitate the complete separation of the blank. Such speed increases are typically on the order of 10:1. That is, the speed of the first blank is removed at ten times the speed of the entire group.

It has been found that blanks separated from overlapping relation by vacuum separating devices, while effectively separated from the group, are displaced from a preselected registered position in the feed path. The rapid acceleration of the separated blank cannot be immediately accomplished by vacuum pressure and, therefore, some degree of slippage occurs causing the blank to lag slightly behind its desired position. For this reason, many separating mechanisms still utilize the frictional separating devices described above.

Therefore, there is a need in sheet feeding operations for a sheet separating device which enables an operator to choose a method of separation, either frictional or vacuum, depending upon the circumstances presented to him.

There also remains a need for an envelope blank separating device which can be efficiently adjusted to separate various sizes and styles of envelope blanks from overlapping relation into spaced tandem relation.

SUMMARY OF THE INVENTION

In accordance with the present invention there is provided apparatus for separating blanks of sheet material including a backing roller adjustably rotatably supported in a frame member. Conveying means is supported in the frame member for moving a group of overlapping blanks toward the backing roll at a preselected speed. The group of overlapping blanks includes a first blank having a leading edge in contact with the backing roller. A rotatable segment roller is rotatably supported in the frame member adjacent to the backing roller. The segment roller includes a pull-out segment radially positioned thereon. The pull-out segment includes selectively operable vacuum sheet engaging means for engaging the leading edge of the first blank in the group of overlapping blanks. Drive means is provided for rotating the segment roller and advancing the conveying means. The segment roller is rotated at a speed greater than the preselected speed of the conveying means for separating the overlapping blanks into spaced relation. The backing roller is adjustable between a first position and a second position. The backing roller first position includes the pull-out segment frictionally engaging the leading edge of the first blank in contact with the backing roller and forcing the first blank away from the group of overlapping blanks to separate the first blank from the group of overlapping blanks. The backing roller second position includes the pull-out segment being spaced apart from the leading edge of the first blank. The vacuum sheet engaging means is activated to engage the leading edge of the first blank and convey the first blank away from the group of overlapping blanks to separate the first blank from the group of overlapping blanks.

Further in accordance with the present invention, there is provided a method for separating blanks of sheet material that includes the step of rotatably supporting in a frame member a backing roller adjustable between a first position and a second position. A segment roller is rotatably supported in the frame member adjacent to the backing roller. A pull-out segment is radially positioned on the segment roller. The pull-out segment is provided with selectively operable vacuum sheet engaging means. A group of overlapping blanks includes a leading blank having a leading edge conveyed at a first preselected speed into contact with the backing roller. The backing roller is moved to the first position so that the pull-out segment is placed in frictional engagement with the leading edge of the leading blank. The segment roller is driven at a second preselected speed greater than the first preselected speed of the conveying means so that the pull-out segment frictionally engages the leading edge of the leading blank to separate the leading blank from the group of overlapping blanks. The backing roller is moved to the second position so that the pull-out segment is removed from the frictional engagement with the leading edge of the leading blank. The segment roller is driven at the second preselected speed greater than the first preselected speed of the conveying means. The activation of the vacuum sheet engaging means is timed to engage the leading edge of the leading blank to the pull-out segment and separate the leading blank from the group of overlapping blanks.

Further in accordance with the present invention, there is provided apparatus for separating blanks of sheet material that includes conveying means supported in a frame member for moving a group of overlapping blanks in a preselected direction at a preselected speed wherein the group of overlapping blanks includes a first blank having a leading edge. A backing roller is rotatably supported in the frame member. The backing roller supports the leading edge of the first blank. A rotatable segment roller is supported in the frame member adjacent to the backing roller. The segment roller includes a pull-out segment radially positioned thereon. Vacuum sheet engaging means is mounted on the pull-out segment for engaging the leading edge of the first blank in the group of overlapping blanks. Drive means rotates the segment roller and advances the conveying means. The backing roller is adjustable between a friction position and a non-friction position with respect to the segment roller for supporting the leading blank from the group of overlapping blanks.

Accordingly, a principal object of the present invention is to provide method and apparatus for separating a sheet from a group of overlapping sheets.

An additional object of the present invention is to provide an adjustable separating device in which a sheet can be separated from a group of overlapping sheets either frictionally or by vacuum.

These and other objects of the present invention will be more completely disclosed and described in the following specification, the accompanying drawings, and the appended claims.

DESCRIPTION OF THE PREFERRED EMBODIMENTS

The adjustable sheet separating method and apparatus of the present invention may be employed with apparatus similar to that illustrated in U.S. Pat. Nos. 3,088,382 and 3,116,668. Detailed descriptions of the manner in which the apparatus is mounted in an envelope machine frame is shown in the prior art and will not be discussed in detail herein. The present invention will be described as it relates to apparatus disclosed in the above enumerated patents, and for this purpose the above enumerated patents are incorporated herein by reference.

Figure 2:
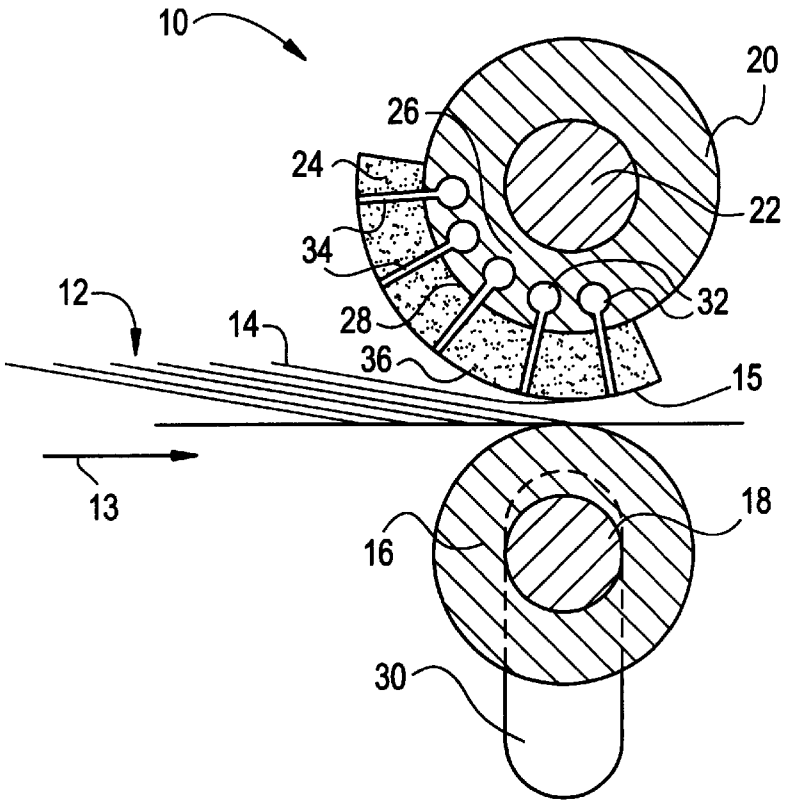
FIG. 2 is a side elevational view of the adjustable sheet separating device, illustrating the vacuum separation mode of the present invention.
Figure 1:
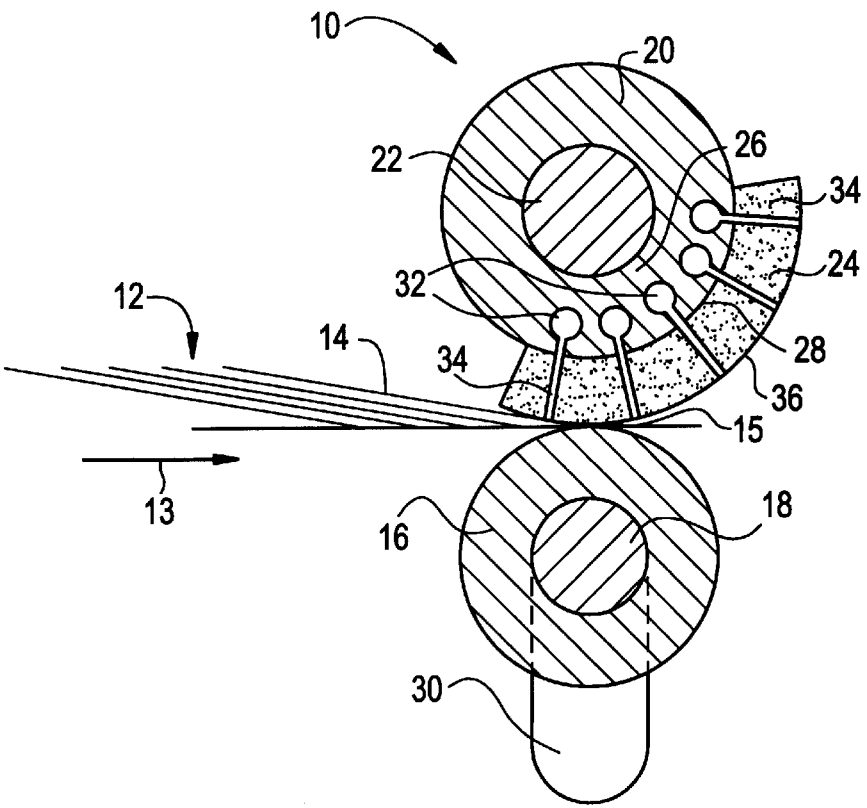
FIG. 1 is a side elevational view of an adjustable sheet separating device, illustrating the frictional separation mode of the present invention.

Referring to the drawings and particularly to FIGS. 1 and 2, there is illustrated an adjustable sheet separating device generally designated by the numeral 10. A group 12 of envelope blanks 14 are fed in overlapping or shingled relation by a conveyor mechanism (not shown) in the direction indicated by the arrow 13. A leading edge 15 of the leading blank 14 in the feed path contacts a backing roller 16. Backing roller 16 is nonrotatably mounted on a driven backing shaft 18 for rotation therewith and is positioned in adjacent relation to the leading edge 15 of leading blank 14. Preferably, backing roller 16 is constructed of steel, however, it should be understood that alternate construction materials are within the scope of the present invention.

A segment roller 20 is nonrotatably mounted on a driven segment shaft 22 for rotation in a counterclockwise direction. A pull-out segment 24 is radially positioned on a portion 26 of the outer surface 28 of segment roller 20. Pull-out segment 24 is preferably made of steel, however, it should be understood that any suitable material is within the scope of the present invention.

Backing shaft 18 is adjustably mounted in housing 30. In accordance with the present invention, housing 30 includes suitable means (not shown) for adjusting the relative position between segment roller 20 and backing roller 16, thereby permitting the operator to choose between two modes of operation depending upon the operating conditions.

Segment roller 20 includes a plurality of longitudinal vacuum supply conduits 32 suitably connected to a source of vacuum pressure (not shown). A plurality of vacuum slots 34 extend radially from the vacuum supply conduits 32 through segment roller 20 and pull-out segment 24 to an outer surface 36 of pull-out segment 24 for generating a progressive vacuum pressure on the outer surface 36 of pull-out segment 24.

Progressive vacuum refers to the ability to apply and remove reduced pressure to the slots 34 sequentially, thus allowing a blank to be engaged or removed from the surface of the pull-out segment 24 systematically rather than all at once. For example, the envelope blank 14 may be engaged beginning at the leading edge 15, followed by the remaining portion of the blank 14 as the segment roller 20 rotates in a counterclockwise direction. It should be understood that vacuum slots 34 may be positioned in any suitable pattern and the locations of slots 34 are not limited to those shown in the figures.

Segment shaft 22 is driven by suitable drive means (not shown) at a speed substantially greater than the speed of the group 12 of envelope blanks 14 traveling on the conveyor mechanism. Preferably, segment shaft 22 is driven at approximately ten times the speed of the overlapping group 12; however, the present invention includes limitless relative velocities between the segment shaft 22 and the conveyor mechanism.

As illustrated in FIG. 1, the adjustable sheet separating device 10 of the present invention is in a first mode of operation. In the first mode of operation, backing shaft 18 is positioned in housing 30 so that, upon rotation, the outer surface 36 of pull-out segment 24 frictionally engages the leading edge 15 of the leading blank 14 resting on backing roll 16. Vacuum pressure to vacuum slots 34 from vacuum supply conduits 32 is deactivated. Upon counterclockwise rotation of segment roller 20 by its drive means (not shown), the outer surface 36 of pull-out segment 24 frictionally engages and grips the leading edge 15 of the first envelope blank 14, separating it from the group of blanks 12.

As illustrated in FIG. 2, the adjustable sheet separating device 10 of the present invention is in a second mode of operation. In the second mode of operation, the backing shaft 18 is positioned in housing 30 so that the outer surface 36 of pull-out segment 24 is spaced apart from the leading edge 15 of leading blank 14 as it rests on backing roller 16. In mode two, as distinguished from mode one, there is no initial frictional contact between the outer surface 36 of pull-out segment 24 and either the leading edge 15 or the backing roller 16.

Upon counterclockwise of the segment shaft 20 by drive means (not shown), negative pressure from the vacuum supply conduits 32 is progressively exerted through vacuum slots 34 to the surface 36 of pull-out segment 24. The negative pressure is applied to the respective slots 34 as they advance into position opposite the blank leading edge 14. When the outer surface 36 of pull-out segment 24 passes the leading edge 15 of envelope blank 14, the negative pressure through vacuum slots 34 is sequentially activated to exert a progressive suction force on the leading edge 15. In this manner the blank leading edge 15 is pulled into engagement with the passing pull-out segment 24.

Rotation of the segment shaft 20 subsequently separates the entire envelope blank 14 from the group of blanks 12. Once separated from the group of blanks 12, the suction force is progressively deactivated, thereby releasing leading blank 14 from engagement with the pull-out segment 24 and advancing it to a subsequent operating station (not shown).

Figure 3:
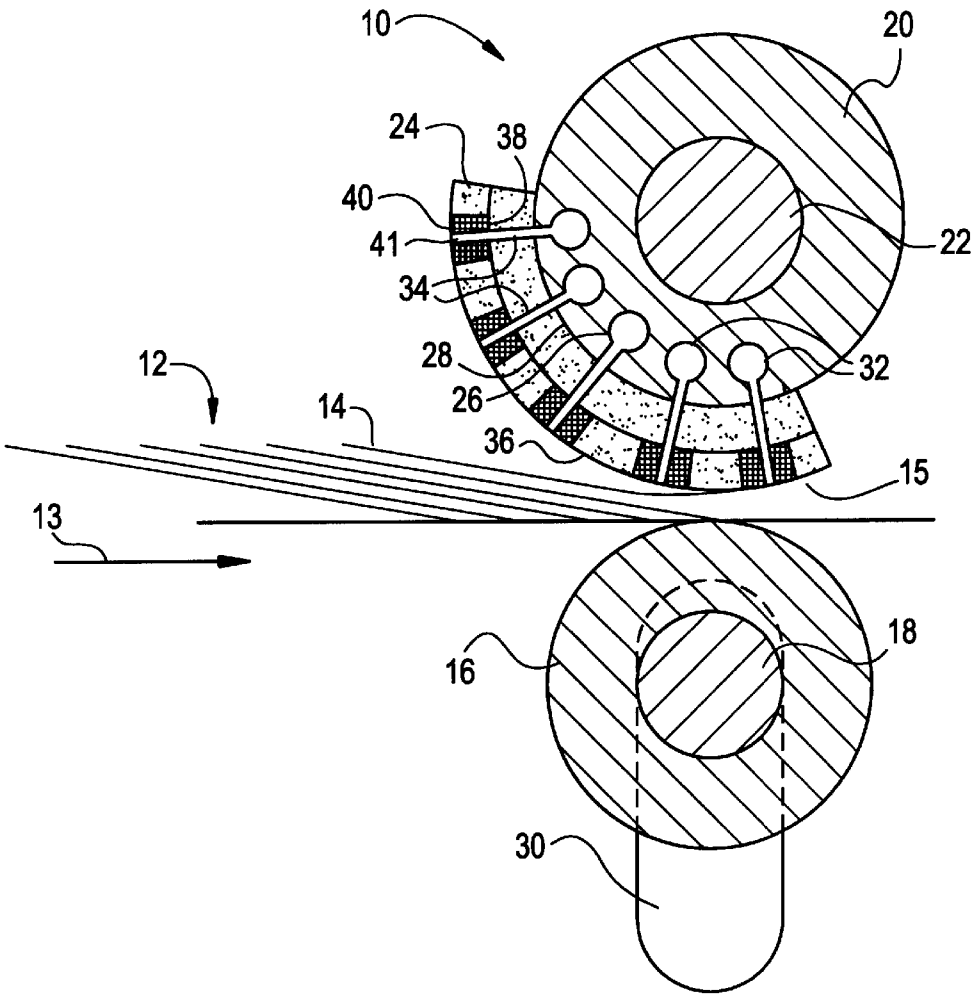
FIG. 3 is a side elevational view of the adjustable sheet separating device shown in FIG. 1, further illustrating friction plugs on the surface of the device.

Now referring to FIG. 3 there is illustrated an alternate embodiment of the adjustable sheet separating device 10 shown in FIGS. 1 and 2. The embodiment of FIG. 3 is shown in its second mode of operation, similar to the embodiment illustrated in FIG. 2. The construction and operation of the sheet separating device 10 shown in FIG. 3 is substantially similar to that shown in FIGS. 1 and 2. However, the outer surface 36 of pullout segment 24 includes a plurality of longitudinal grooves 38 therein. The grooves 38 are positioned in expanded radial alignment with the vacuum slots 34 so that vacuum slots 34 extend into the grooves 38 a preselected radial distance from the outer surface 36 of pull-out segment 24. A plug 40 is secured in each longitudinal groove 38. Each plug 40 substantially fills a groove 38 and includes a radial slot 41 therein. Slots 41 are aligned with vacuum slots 34 in pull-out segment 24, thereby permitting progressive vacuum pressure from vacuum supply conduits 32 to extend through plugs 40 to the surface 36 of pull-out segment 24.

Preferably, the plugs 40 are formed of a resilient material such as urethane or rubber, however, any suitably resilient material may be used. The positioning of plugs 40 in the outer surface 36 of pull-out segment 24 provides an area of increased friction adjacent the vacuum slots 34 and serves to substantially reduce or prevent the slippage of the leading edge 15 of leading blank 14 along the outer surface 36 of pull-out segment 24 during the second mode of operation of the adjustable sheet separating mechanism 10 of the present invention.

According to the provisions of the patent statutes, we have explained the principle, preferred construction and mode of operation of our invention and have illustrated and described what we now consider to represent its best embodiments. However, it should be understood that, within the scope of the appended claims, the invention may be practiced otherwise than as specifically illustrated and described.

We claim:

1. Apparatus for separating blanks of sheet material comprising, a backing roller adjustably rotatably supported in a frame member, conveying means supported in said frame member for moving a group of overlapping blanks toward said backing roller at a preselected speed wherein the group of overlapping blanks includes a first blank having a leading edge in contact with said backing roller, a segment roller rotatably supported in said frame member adjacent to said backing roller, said segment roller including a pull-out segment radially positioned thereon, said pull-out segment including selectively operable vacuum sheet engaging means for engaging the leading edge of the first blank in the group of overlapping blanks, drive means for rotating said segment roller and advancing said conveying means, said segment roller rotating at a speed greater than said preselected speed of said conveying means for separating the overlapping blanks into spaced relation, said backing roller being adjustable between a first position and a second position, said backing roller first position including said pull-out segment frictionally engaging the leading edge of the first blank in contact with the backing roller and forcing the first blank away from the group of overlapping blanks to separate the first blank from the group of overlapping blanks, said backing roller second position including said pull-out segment being spaced apart from the leading edge of the first blank, and said vacuum sheet engaging means being activated to engage the leading edge of the first blank and convey the first blank away from the group of overlapping blanks to separate the first blank from the group of overlapping blanks.

2. Apparatus for separating blanks of sheet material as set forth in claim 1 which includes, said backing roller being adjustably mounted in a housing, and said backing roller being movable in said housing between said first position and said second position.

3. Apparatus for separating blanks of sheet material as set forth in claim 1 in which, said selectively operable vacuum sheet engaging means includes said segment roller including a plurality of vacuum supply conduits positioned longitudinally therein, said vacuum supply conduits being selectively connected to a source of negative pressure, and said pull-out segment including a surface having a plurality of longitudinal slots therein extending radially through said segment roller into said vacuum supply conduits for permitting selective exertion of negative pressure to said surface of said pull-out segment.

4. Apparatus for separating blanks of sheet material as set forth in claim 3 in which, said surface of said pull-out segment has a plurality of grooves therein aligned in expanded radial relation to said longitudinal slots, said grooves being substantially filled with a plurality of plugs, and each of said plugs having a longitudinal slot therein aligned with said longitudinal slot of said pull-out segment for permitting negative pressure to be selectively exerted through said plugs to the surface of said pull-out segment.

5. Apparatus for separating blanks of sheet material as set forth in claim 4 in which, said plugs are formed of a resilient material to enhance the frictional characteristics of said pull-out segment adjacent said longitudinal slots.

6. Apparatus for separating blanks of sheet material as set forth in claim 5 in which, said plugs are formed of urethane.

7. A method for separating blanks of sheet material including the steps of, rotatably supporting in a frame member a backing roller adjustable between a first position and a second position, rotatably supporting a segment roller in the frame member adjacent to the backing roller, radially positioning a pull-out segment on the segment roller, providing the pull-out segment with selectively operable vacuum sheet engaging means, conveying a group of overlapping blanks including a leading blank having a leading edge at a first preselected speed into contact with the backing roller, moving the backing roller to the first position so that the pull-out segment is placed in frictional engagement with the leading edge of the leading blank, driving the segment roller at a second preselected speed greater than the first preselected speed of the conveying means so that the pull-out segment frictionally engages the leading edge of the leading blank to separate the leading blank from the group of overlapping blanks, moving the backing roller to the second position so that the pull-out segment is removed from frictional engagement with the leading edge of the leading blank, driving the segment roller at the second preselected speed greater than the first preselected speed of the conveying means, and timing activation of the vacuum sheet engaging means to engage the leading edge of the leading blank to the pull-out segment and separate the leading blank from the group of overlapping blanks.

8. A method for separating blanks of sheet material as set forth in claim 7 which includes the steps of, adjustably mounting the backing roller in a housing movable between the first and second positions.

9. A method for separating blanks of sheet material as set forth in claim 7 which includes, longitudinally securing a plurality of vacuum supply conduits in the segment roller, selectively securing the vacuum supply conduits to a source of negative pressure, and positioning a plurality of longitudinal slots in the surface of the pull-out segment extending radially through the segment roller to the vacuum supply conduits for permitting selective exertion of negative pressure to said surface of said pull-out segment.

10. A method for separating blanks of sheet material as set forth in claim 9 which includes, providing the surface of the pull-out segment with a plurality of longitudinal grooves in expanded radial alignment with the longitudinal slots, and substantially filling the longitudinal grooves with a plurality of plugs each having a longitudinal slot therein aligned with the longitudinal slot in the pull-out segment for permitting selective exertion of negative pressure through the plug to the surface of the pull-out segment.

11. A method for separating blanks of sheet material as set forth in claim 10 which includes, forming the plurality of plugs from a resilient material to enhance the frictional characteristics of the surface of the pullout segment adjacent the longitudinal slots.

12. A method for separating blanks of sheet material as set forth in claim 11 which includes, forming the plurality of plugs from urethane.

13. Apparatus for separating blanks of sheet material comprising, conveying means supported in a frame member for moving a group of overlapping blanks in a preselected direction at a preselected speed wherein the group of overlapping blanks includes a first blank having a leading edge, a backing roller rotatably supported in said frame member, said backing roller supporting the leading edge of the first blank, a rotatable segment roller supported in said frame member adjacent to said backing roller, said segment roller including a pull-out segment radially positioned thereon, vacuum sheet engaging means mounted on said pull-out segment for engaging the leading edge of the first blank in the group of overlapping blanks, drive means for rotating said segment roller and advancing said conveying means, and said backing roller movable between a friction position and a non-friction position for separating the leading blank from the group of overlapping blanks.

14. Apparatus for separating blanks of sheet material as set forth in claim 13 which includes, said segment roller rotating at a speed greater than said preselected speed of said conveying means for separating the group of overlapping blanks into spaced relation.

15. Apparatus for separating blanks of sheet material as set forth in claim 13 which includes, said backing roller being adjustably mounted in said frame member, and said backing roller being movable in said frame member between said friction position and said non-friction position.

16. Apparatus for separating blanks of sheet material as set forth in claim 13 in which, said friction position includes said pull-out segment frictionally engaging the leading edge of the first blank in contact with said backing roller and forcing the first blank away from the group of overlapping blanks to separate the first blank from the group of overlapping blanks, said non-friction position including said pull-out segment being spaced apart from the leading edge of the first blank in contact with said backing roller, and said vacuum sheet engaging means being activated to engage the leading edge of the first blank on the surface of said pull-out segment and convey the first blank away from the group of overlapping blanks to separate the first blank from the group of overlapping blanks.

17. Apparatus for separating blanks of sheet material as set forth in claim 13 in which, said vacuum sheet engaging means includes said segment roller having a plurality of vacuum supply conduits longitudinally positioned therein, said pull-out segment including a surface having a plurality of longitudinal slots therein, each of said longitudinal slots being in fluid contact with one of said vacuum supply conduits, and said vacuum supply conduits being selectively connected to a source of negative pressure for applying progressive vacuum to the surface of said pull-out segment.

18. Apparatus for separating blanks of sheet material as set forth in claim 17 in which, said surface of said pull-out segment has a plurality of grooves therein aligned in expanded radial relation to said longitudinal slots, each of said grooves being substantially filled with a plug, and each of said plugs having a longitudinal slot therein substantially aligned with said longitudinal slot of said pull-out segment for permitting negative pressure to be selectively exerted through said plugs to the surface of said pull-out segment.

19. Apparatus for separating blanks of sheet material as set forth in claim 18 in which, said plugs are formed of a resilient material to enhance to frictional characteristics of said pull-out segment adjacent said longitudinal slots.

20. Apparatus for separating blanks of sheet material as set forth in claim 18 in which, said plugs are formed of urethane.

* * * * *